United States Patent [19]

Kaufman

[11] 4,216,640

[45] Aug. 12, 1980

[54] UNIT LOAD WRAPPING MACHINE

[76] Inventor: Charles R. Kaufman, 6728 Santo La., Maumee, Ohio 43537

[21] Appl. No.: 914,938

[22] Filed: Jun. 12, 1978

[51] Int. Cl.[3] ..... B65B 11/04

[52] U.S. Cl. ..... 53/556; 53/587

[58] Field of Search ..... 53/451, 211, 556, 587, 53/588

[56] References Cited

U.S. PATENT DOCUMENTS

| | | | |
|---|---|---|---|
| 2,529,732 | 11/1950 | Howard | 53/551 |
| 3,003,297 | 10/1961 | Broadhead et al. | 53/588 |
| 3,370,394 | 2/1968 | Taylor | 53/211 |
| 3,548,563 | 12/1970 | Leasure | 53/451 |
| 4,077,179 | 3/1978 | Lancaster et al. | 53/211 |
| 4,110,957 | 9/1978 | Lancaster et al. | 53/589 |
| 4,152,879 | 5/1979 | Shulman | 53/587 X |

FOREIGN PATENT DOCUMENTS

| | | | |
|---|---|---|---|
| 2717647 | 11/1978 | Fed. Rep. of Germany | 53/587 |
| 690443 | 7/1950 | United Kingdom | 53/588 |

*Primary Examiner*—John Sipos
*Attorney, Agent, or Firm*—George R. Royer

[57] ABSTRACT

A machine for wrapping a plurality of individual packages, or other containers arranged in a bundle, with a stretchable material, of generally transparent constituency, said machine including automatic means to wrap said bundle of packages with successive layers of such overlapping stretchable material, and said machine including additional automatically actuated holding and cutting bars which serve to cut the trailing edge of said wrapped material while the wrapping material is disposed in a vertical position, with further means on said machine to position said holding and cutting bars in a position beneath the load to be wrapped in order that said holding and cutting bars do not interfere with the wrapping cycle. Said holding and cutting bars may optionally have electrically headed resistance wires integrally disposed therein for facilitating the process of cutting the wrapping material at the end of the wrap cycle.

2 Claims, 7 Drawing Figures

UNIT LOAD WRAPPING MACHINE

KNOWN PRIOR ART

There are several disclosures and patents which are of peripheral relevance only to this invention. These are:

(a) U.S. Pat. No. 3,968,806 (Lancaster)

DISCUSSION OF PRIOR ART

The subject invention pertains to stretch wrapping machines in general, and in this regard, stretch wrapping machines are devices which are equipped to automatically wrap a plurality of individualized packages with successive layers of stretchable material so as to form a unitized bundle. Usually these individualized packages are grouped together in a substantially symmetrical arrangement on a pallet or other similar base. For purposes of facilitating shipping these individual packages together as a unit, it has been found desirable to wrap a stretchable material, having reasonable and substantial tensile strength, around the bundle of packages so as to enclose the bundle as a cohesive unit. Such a unitized bundle facilitates shipping, material handling, and further helps minimize spoilage by reason of weather exposure and alleviates the problem of pilferage. Thus, using stretchable wrapping material of optimal tensile strength renders the resultant wrapped bundle sufficiently durable and impregnable for secure handling in all shipping processes. and locations. This procedure of enclosing a plurality of packages obviously saves subsequent material handling and shipping costs, as stated, since individual packages are not exposed and need not be handled at each shipping or handling junction.

There are a variety of machines and concomitant processes conceived to wrap individual packages, as a unitized package, as discussed above. In the earlier stages of this art, packages were most frequently unitized by a heat shrink process in which the bundle of containers were covered by a loose fitting plastic cover which is subsequently shrunk by heat into a more tightly fitting enclosure for the unitizing process. These types of processing machines are still in use to some degree.

Presently, most machines are equipped to wrap package bundles with successive layers of a transparent material of a polyethylene or other similar plastic base. These latter types of machines are referred to as stretch wrap types. Generically speaking, there are two basic categories of stretch wrap machines, one the full web and the other a partial or spiral web. A full web wrap operates with a width of wrapping material which is substantially the same distance as the height of the bundle of containers. This full web wrap machine thus encircles the bundle of containers with the wrapping layer in a wrap that extends completely from the bottom to the top, of the bundle, and thus there is no need to wrap the bundle of containers in spiral fashion.

The spiral wrap process machine involves using a roll of wrapping material which has a width which is less than the height of the bundle of containers. Since the wrapping material width is less than the height of the bundle, it is necessary, to use a spiral wrapping process wherein the wrapping material is initially placed against the bottom of the bundle of containers and thence wrap the stretchable material around the entire bottom perimeter of the bundle. Upon subsequent wrap cylces the machine will cause the roll of wrapping material to gradually rise along the bundle perimeter as it is encircled thereabout, and thus the wrapping material gradually moves above each of the preceding layers in an overlapping and spiraling fashion. The final wrap-around can occur near the top of the bundle, although in most spiral wrap machines the wrap process is caused to recede back towards the bottom of the bundle in reverse spiral movements, with a completion of the wrap cycle at the starting point at the bottom of the bundle. At the completion of the wrap cycle at the bottom, the material is severed to form a trailing edge on the wrapped bundle and a leading edge for the start of the next cycle.

Automatic spiral wrap machines have distinct advantages over automatic full web wrap machines in several particulars. One such advantage is that the automatically operated spiral wrap machines are relatively more simple in construction and operation, thus entailing less expensive equipment. However, in using a spiral wrap, there are some limitations and, in some instances, the limitations are common to both the full web type and the spiral web type.

One of the limitations encountered in using both the full web and spiral web stretch wrapping process, is that virtually all the machines existing in the prior art necessarily utilize holding and cutting arms which extend vertically upwardly. It is to be noted that the holding arms function to hold the wrapping material in an appropriate position for the initial stages of the wrapping process while the cutting arms serve to sever the wrapping material at the end of the wrap cycle. This vertical arrangement of the separate holding and cutting bars significantly facilitates the process of cutting the trailing edge of the wrapping material to form both a trailing edge and a leading edge for the next wrapping cycle. Cutting the trailing edge of the wrapping material while it is in the vertical position substantially helps to create a more optimal cutting situation for severing the wrapping material. One such reason is that when the trailing edge is cut in a horizontal position, the wrapping material easily becomes twisted relative to the existing vertical planar disposition of wrapping material as it rolls off a vertically disposed roll. This resultant twisting at the cutting stage makes it more difficult to affix the trailing edge to the side of the unitized bundle. Moreover, a twisted, contorted trailing edge renders the bundle aesthetically unpresentable, as well as less likely to stay cohesively wrapped. On the other hand, if the leading edge of the wrapping material is vertically disposed it is much easier to commence the next successive wrapping cycle. Certain partial web machines existing in the art utilize a horizontally aligned cutting process, however those machines necessarily entail cumbersome and complex cutting mechanisms which while somewhat satisfactory can create a larger manufacturing costs.

Consequently, as clearly evident from the above, most automatic full web and automatic spiral web machines in the stretch wrap art have utilized vertically disposed cutting and holding arms in order to maintain the wrapping material in a substantially vertical position at all times, particularly at the cutting stage. However, the resultant necessity of using vertically disposed holding and cutting arms, as described, does yield another problem. In automatic full web and spiral web machines, vertically disposed cutting and holding arms must be positioned sufficiently close to the bundle with the arms extending upwardly above the bottom of the platform holding the bundle, since the cut at the appropriate interval must be made of the wrapping material while the material is vertically disposed around portions of the bundle above the bottom-most area. The disadvantage of having the holding arms extending above the bottom of the platform is that the entire wrapping process must then evolve around the outside of the holding arms; and in this latter situation, it is difficult to impose full tension initially on the wrapping material. Full tension during these initial phases can cause ripping of the material at the beginning due to short holding arms or during arm retract. Therefore, in those machines with the holding arms upright during the initial wrap cycle, the stretch material is necessarily subjected to less than full tension in the initial wrapping process before the arms are retracted. This imposition of less than full tension is economically wasteful as it causes a loose, and therefore useless, initial wrap or wraps, and does lead in some situations to an insecure wrap of the bundle.

An additional problem with most machines using vertical arms which are proximately located near bundle is that such machines mandate that the bundle be precisely located on the wrapping platform before commencement of the wrapping cycle. If the load is not accurately located, uneven pull or tension is placed on the wrapping material which during holding arm retraction has a tendency to rip. Thus, to avoid this problem the bundled load must be located as nearly as possible to the holding arms to avoid wrapping and arm retraction problems. This creates a demand for expensive precision machinery, and therefore, it is obvious to determine that as the bundle is initially wrapped with the first few layers, the necessity of maintaining the holding bars upright does lead to some problems of interference with the wrapping process.

Still another aspect of the prior art pertinent to this invention is that almost all stretch wrap machines utilize separate holding arms and cutting arms. This duplicity leads to a more expensive and complex machine, as well as added maintenance costs.

Yet another problem involved with the process of severing the wrapping material in stretch wrapping machinery involves the problem of uniformly and simultaneously severing or cutting the trailing edge. If the trailing edge is not evenly severed in a simultaneous severing action, the trailing edge of the wrapping material has a slight tendency to twist about the part of the wrapping material that is either incompletely severed or that part that is subsequently severed out of phase with the rest of the width of the wrapping material. Such uneven and uncoordinated cutting is frequently encountered in all package wrapping machines of the type wherein a vertical cut is consummated by a scissors-like action of two opposing members rising to meet each other along a common vertical axis. This uneven cutting results in large part from the uneven force moments along various distances of the scissor arms, as those points along the arms which are closer to the fulcrum will have a different movement than those points more distant.

When an uneven cut is encountered it is difficult to seal the trailing edge against the rest of the wrapped material, as some twisting may occur. This imperils the physical integrity of the wrapped bundle, as described above. Moreover, the use of scissor-like cutting members can be relatively expensive, and may require frequent replacement.

The subject invention is conceived and addressed to help correct and alleviate the foregoing problems, and the following objects are directed accordingly.

OBJECTS

It is an object of the subject invention to provide an improved stretch wrapping machine;

It is another object of the subject invention to provide an improved cutting and holding mechanism for a stretch wrap machine for unitizing pallet loads;

Yet another object of the subject invention is to provide an improved device for wrapping a plurality of packages in a unitized bundle;

Still another object is to provide an improved wrapping device for a stretch wrap machine;

It is an object of the subject invention to provide a stretch wrapping machine which allows full tension to be placed on the wrapping material during all phases of the wrapping cycle;

It is also an object of the subject invention to provide an improved method of severing wrapping material at appropriate intervals for stretch wrapping machinery;

Yet another object is to provide an improved device for an economical process of wrapping package bundles;

A further object of the subject invention is to provide an improved mechanism for manipulating, holding, and cutting the wrapping material at the desired interval;

Other objects of the subject invention will become manifest from a reading of the following description taken in conjunction with the drawings.

DRAWINGS

DESCRIPTION OF GENERAL EMBODIMENT

Figure 1:
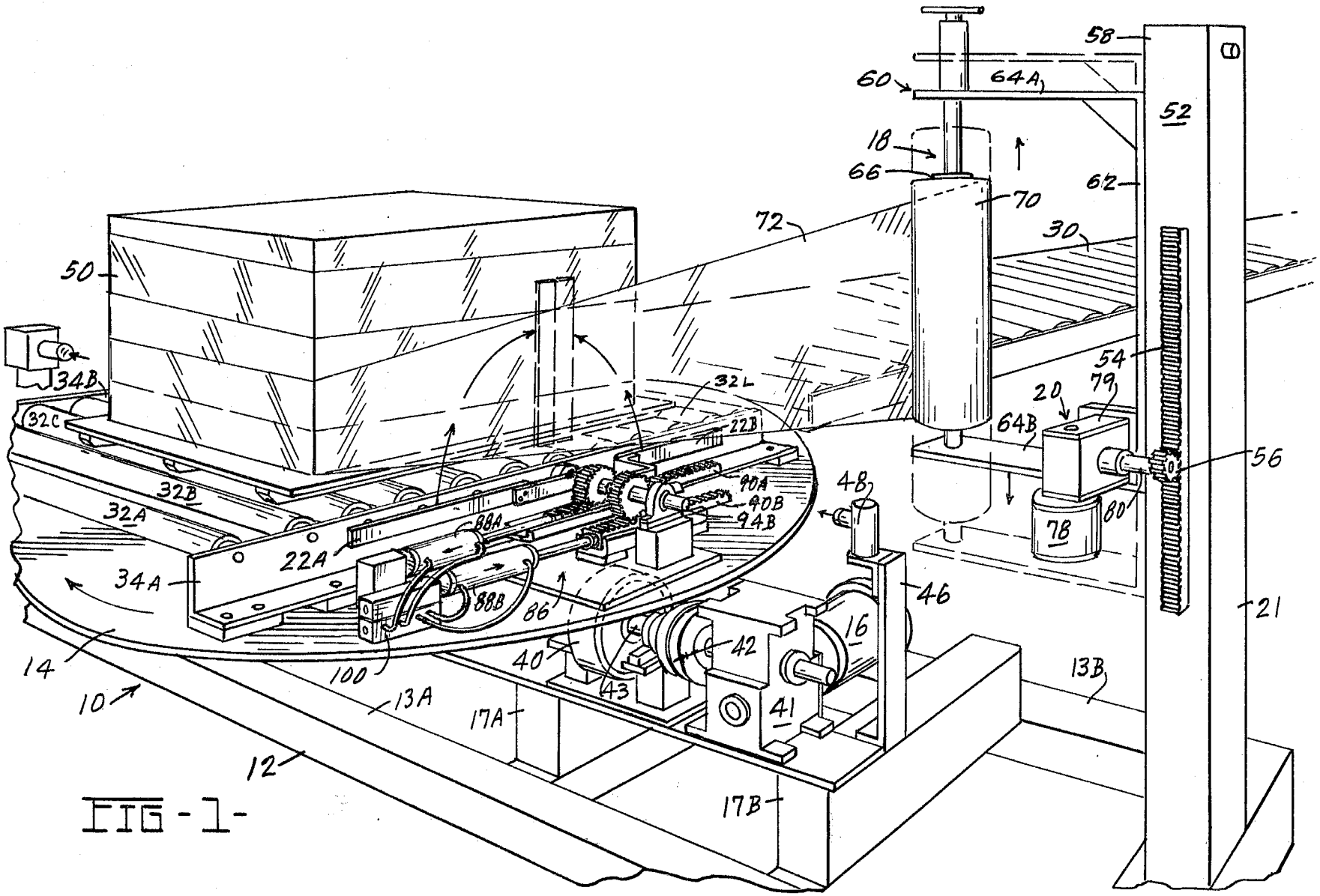
FIG. 1 is a perspective view of the stretch wrapping machine incorporating the subject invention.

The subject invention is a stretch wrapping machine for wrapping a plurality of packages assembled in either a symmetrical or asymetrical bundle. The invention herein pertains to either the full web or partial web wrap machine however the invention herein pertains mainly to machines utilizing a spiral wrapping process to cover the bundle of packages.

The invention is embodied and centered on the specific holding and cutting mechanism in the form of opposing arms functioning to hold, center, and subsequently cut the wrapping material to form the trailing edge of the wrapping material just as it has completed its final wrap cycle encircling the bundles. In general, this severing process is basically produced by the action of two opposing retractible arms that close towards one another in a scissors-like action to hold the wrapped material in a vertical position for cutting. After cutting by mechanical means the holding and cutting arms, while still clasped together, are moved in a ninety degree arcuate movement to a substantially horizontal position adjacent and approximately parallel to the lower edge of the upper surface of the loading platform. The arms hold the leading edge of the wrapping material while in this latter substantially horizontal position for a predetermined number of wrap cycles once the wrapping commences by rotation of the bundle.

Upon the completion of the initial wrap-around cycle, one arm of the two is moved one hundred and eighty degrees to an opposing horizontal position for purposes of releasing the strand of wrapping material for unhindred movement as it is wrapped around the bundle and for the further purpose of readiness for the subsequent cutting phase at the end of the cycle. The arms are held in this retracted horizontal position during most of the wrap cycle. When the wrap cycle is about to be completed, the opposing arms move ninety degrees, in a reverse arcuate movement, thus closing towards one another in a vertical position for the next successive cutting operation.

The cutting edge is integrally affixed along the length of one or both of the retractible holding and cutting arms so that as the two arms met each other in a juxtaposed aligned position, which is vertically lengthwise, the cutting edge embraces the entire width of the wrapping material held between the arms for the final cut.

The subject invention optionally uses, in lieu of a wedged-shaped cutting blade on one or more arm, an electrically heated cutting wire that extends completely along the entire inside length of one or more of the retractible cutting arms. More particularly, integrally embedded along the inside surface of at least one of the two holding and cutting arms is a wire comprised of a material of relatively high electrical resistance, which upon the passage of sufficient electrical current there through will emit sufficient quantities of heat from its peripheral surfaces so as to melt any plastic wrapping materials embraced to said cutting edge. This latter phenomena serves to sever the wrapping material as stated. The device operates such that as the cutting arms close towards one another, current of moderately high voltage is generated through the resistance wire just as the arms are about to meet each in a vertically upright position and clasp the trailing edge of wrapping material. When the current of moderately high voltage is induced through the wire, it will thereby generate the heat along the surfaces of the resistance wire required to cause a melting and breaking of the stretch wrap material. Since the heat will be substantially uniform over the resistance wire, a uniform and even simultaneous breaking of the stretch material will occur.

DESCRIPTION OF PREFERRED EMBODIMENT

In describing a preferred embodiment of the subject invention, it must be noted that this description is of only one embodiment which the subject invention can assume. Additionally, the following description will be of an embodiment in the spiral web type machine, but its application is not to be so limited. Moreover, in the following description the following terminology among other will be utilized:

(a) The word "machine" will refer to a stretch wrapping machine of the spiral web type.

(b) The word "upper" will refer to those areas of the machine which are generally vertically above the loading platform. The word "lower" will refer to those areas generally directed vertically downward from the loading platform.

(c) The word "loading platform" will refer to that rotatable platform upon which containers are wrapped.

(d) The word "axial" will refer to any imaginary axis extending symetrically through the longitudinal extent of the part discussed.

(e) The word "arms" will refer generally to the holding and cutting arms.

Figure 2:
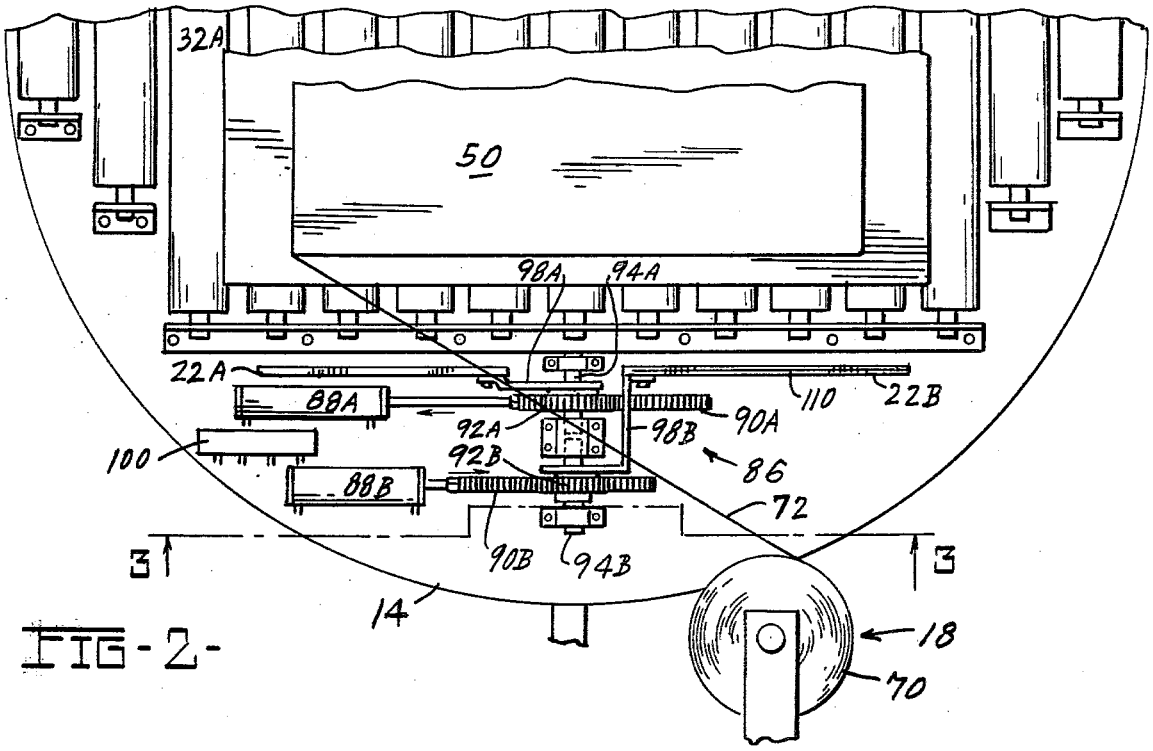
FIG. 2 is a planar view of the stretch wrapping machine incorporating the subject invention.

Referring now more particularly to the drawings, and specifically to FIGS. 1 and 2. FIG. 1 is a perspective view of a spiral stretch wrap machine 10 incorporating the subject invention. Machine 10 is fundamentally comprised of: a base member 12 of generally rectangular disposition, and more particularly comprised of two parallel beams 13A and 13 B; a rotatable loading platform 14, shown as being of generally circular configuration; locomotion means to drive the rotatable platform, in the form of a electrical motor 16 mounted to the base 12 on mutually parallel cross bars 17A and 17B; a roll dispenser 18 to unravel a continuous sheet of wrapping material; lift means 20, located on a vertical support stanchion 21, as supported on base 12, said lift means 20 being equipped to raise and lower the vertical level of the roll dispenser 18; and holding and cutting arms 22A and 22B for positioning, holding and cutting the wrapping material as appropriate. The interrelationship and operations of these parts are more fully described below.

Stretch wrapping machine 10 is generally juxtaposed in a conveyor line such as the roller type conveyor 30, as shown in FIG. 1. More particularly, the platform portion of machine 10 is aligned between two sections of the roller conveyor 30, as shown. In order to provide, as necessary, a continuous conveyor movement, a plurality of roller members 32A, 32B, 32C . . . 32L, are mounted in bearing supports on the upper surface of platform 14 between two mutually parallel roller support members 34A and 34B. Roller members 32A, 32B, 32C . . . 32L are mounted parallel to the rollers on the conveyor 30, and perpendicular to the parallel roller support members 34A and 34B, as seen in the drawings.

The rotating platform 14, as seen, is preferably of circlar configuration, and is driven in its rotational path by a wheel 40 driven by motor 16 through gear box 41 and coupling unit 42 on shaft 43. As readily determined from the drawings, the upper portion of wheel 40 tangentially impinges on the bottom surface of platform 14, and therefore as wheel 40 is driven it causes platform 14 to rotate in a clockwise motion for the embodiment shown in the drawings.

Positioned on vertical support bar 46, which is integrally appended to cross bar 17B, is an electronic eye detector 48 utilizing a double beam detector system. The electric eye 48 functions to detect the positioning of a load 50 on platform 14, thereby generating a signal to the control mechanisms for appropriate actuation and coordinated movement of the motor 16, lift device 20, and holding and cutting arms 22A and 22B.

As stated above, integrally affixed to the base 12 is a vertically extending stanchion 21, which is situated on that end of base 12 which is proximate to the arms 22A and 22B, as represented in FIGS. 1 and 2. Affixed to the one vertical wall 52 of said stanchion 21 is a vertically extending ratchet bar 54 with a ratchet follower gear 56 engaging said bar 54, as shown in FIG. 1. On the adjacent wall 58 of stanchion 21 which faces the platform 14 are vertically extending track members, not shown, to which is slidably mounted the backside of a U-shaped elevator member 60.

Elevator member 60 is comprised of a vertically extending plate member 62, of rectangular disposition. The back of said plate member 62 is slidably mounted on the track members on wall 58 of stanchion 21. Projecting in a perpendicular and horizontal direction from the respective ends of plate member 62 are the upper and lower elevator support members 64A and 64B. Disposed vertically between upper and lower elevator support members 64A and 64B is a cylindrically shaped spool member 66 which is adapted to hold in a correspondingly vertically upright position a cylindrically disposed roll 70 of plastic wrapping material 72, preferably of transparent constituency. Spool 66 is adapted to unravel the wrapping material 72 from roll 70 in either a clockwise or counterclockwise movement, as desired for the particular wrapping operation. Moreover, the roll 70 of wrapping material is preferably subjected to a braking action to impart tension to the wrapping material 72 so that it does not unravel free of any restraint off said roll 70. In this latter respect, if there is no braking restraint on roll 70, the resultant absence of tension would lead to a rather loosely and ineffectively wrapping around the bundle to be wrapped.

A lift motor 78 is attached to the lower elevator support member 64B. An intermediately disposed gear box 79 joined to motor 78 rotates drive shaft 80 which in turn drives ratchet follower gear 56 up and down the ratchet member 54. By this latter action the elevator member 60 is mechanically raised and lowered relative to the stanchion 21. This process of raising and lowering the elevator 60 serves to raise and lower the level of the spool member 66 to enable the wrapping material 72 to be placed at increasingly higher levels, or decreasingly lower levels around the bundle to be wrapped.

Figure 3:
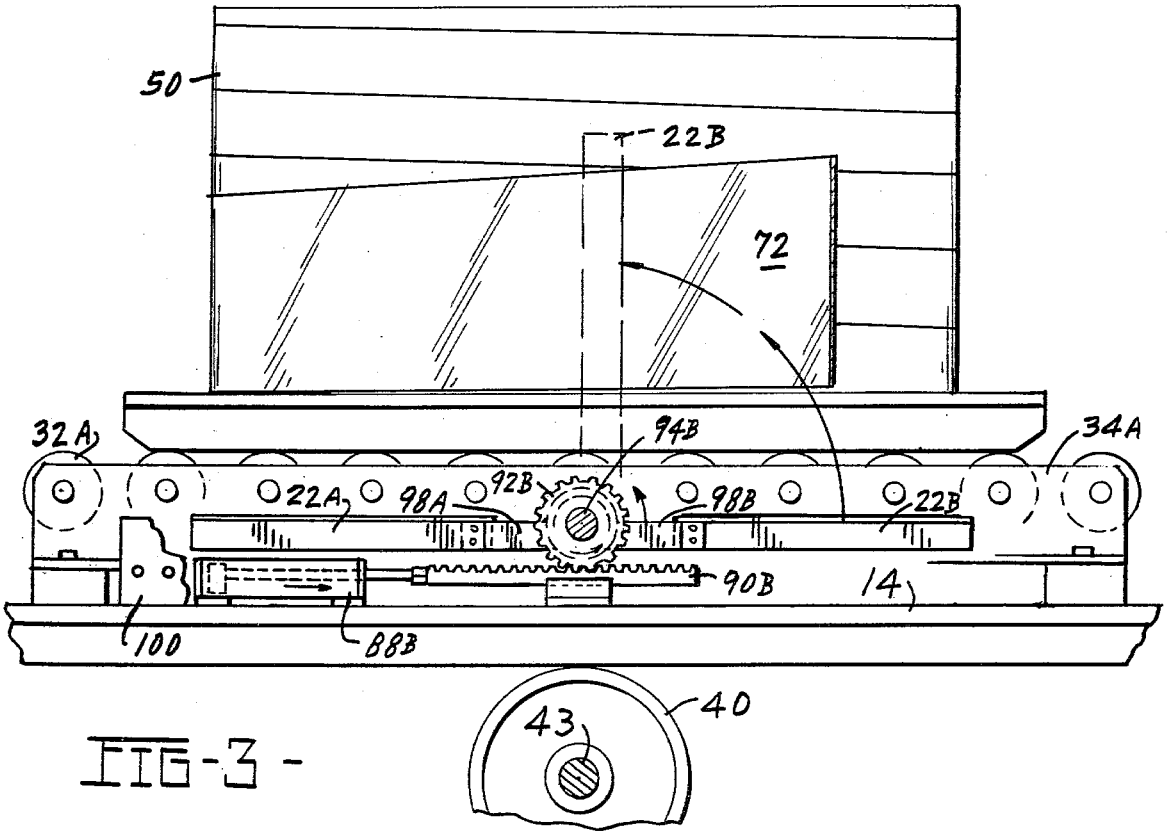
FIG. 3 is an elevational view, viewed from Section 3—3 of FIG. 1, of the holding and cutting arm mechanism constituting the subject invention.

As seen in FIGS. 1 and 3, the parallel roller support members 34A and 34B extend a minimal distance of a few inches vertically above the upper surface of platform 14. As a consequence of the latter extension, the upper portion of the roller members 32A, 32B . . . 32L are even slightly higher above the upper surface of the platform 14, and therefore, the upper tangentially exposed surfaces of the roller members 32A, 32B . . . 32L effectively become the working surface level upon which the bundle rests for wrapping purposes.

The resultant vertical clearance between the upper tangentially exposed surface of the roller members 32A, 32B . . . 32L and the upper surface of platform 14 provides the spaced vertical distance into which are placed holding and cutting arms 22A and 22B, along with their respective arm control mechanisms, hereinafter more fully described. The ability to maintain the control mechanisms and the arms 22A and 22B below the level of the upper surfaces of rollers 32A, 32B . . . 32L while in the downwardly retracted position, shown in FIG. 3, is one of the desirable attributes of the subject invention, as such positioning keeps the holding and cutting means out of the way of the unraveling wrapping material 72 during most of the wrapping cycle. Additionally, since the arms 22A and 22B are so retracted they are less likely to cause any tearing or entanglement with the wrapping material during the wrapping process.

Specifically, direction attention now to the holding and cutting mechanism, which incorporates the vital features of this invention, it must be stressed that the following description is only of one preferred embodiment, and the description of a particular embodiment as based on specific mechanical and electrical structures should not be considered as limiting the scope of the invention described and claims.

In the general operation of the subject invention the arms 22A and 22B function both as holding devices for the wrapping material and cutting devices for cutting the wrapping material at the completion of the wrap cycle. In almost all prior art stretch wrapping materials there are separate arms for cutting the wrapping material and separate arms for holding the wrapping material in appropriate position during at least a portion of the total wrap cycle. In the subject invention, the arms 22A and 22B perform both these indicated holding and cutting functions, and as a direct result of the unification of these functions the complexity and resultant cost of a machine incorporating the subject invention is substantially reduced.

Turning now to FIGS. 2,3,4,5, and 6 of the drawings in order to more particularly define and describe the precise functional relationships and positions between arms 22A and 22B, the overall control and operation mechanism 86 for manipulating arms 22A and 22B is shown in planar view in FIG. 2. Specifically, affixed to the top of platform 14 are two air cylinder members 88A and 88B each adapted to push or pull, as the case may be, respectively connected longitudinal ratchet members 90A and 90B. In particular, longitudinal ratchet member 90A is co-axially aligned with air cylinder 88A, and correspondingly longitudinal ratchet member 90B is aligned co-axially with air cylinder 88B. The respective air cylinders 88A and 88B move their respectively conjoined ratchets back and forth depending on the air flow direction in the individual cylinder. Each ratchet 90A and 90B is in turn geared to circular gears 92A and 92B, which move clockwise or counterclockwise depending on the motion of the mating ratchet bar. The gear 92A is fixedly mounted on a rotatable shaft 94A, while the gear 92B is fixedly mounted on a rotatable shaft 94B. The respective shafts 94A and 94B are individually separated, however, these two shafts are aligned along the same imaginary longitudinal central axis and thus each shaft 94A and 94B has a common axis of rotation. Stated alternately, each shaft 94A and 94B, although rotatable independently of one another, do rotate about a common central axis of rotation.

Concentrically but fixedly mounted about rotatable shaft 94A is ring member 96A, while ring member 96B is similarly mounted about shaft member 94B. More particularly, ring member 96A is fixedly mounted for unitary rotation with shaft 94A, and is mounted on such shaft in a direction away from gear 92A and towards the platform 14. In similar fashion, ring member 96B is affixed on shaft member 94B for unitary rotation therewith, and is mounted on that side of gear 92B which is towards the platform 14.

Figure 7:
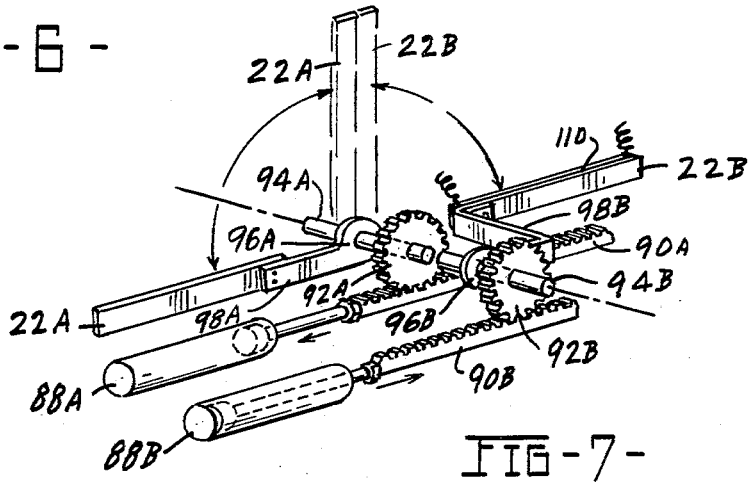
FIG. 7 is a perspective view showing the mechanical members used to actuate movement of the respective holding and cutting bars.

Affixed to a portion of the outer circumference of ring member 96A is an L-shaped connecting arm 98B, as seen in the drawings. The opposite or extreme end of the L-shaped arm 98B is integrally affixed to inner end of arm 22B. Moreover, it is to be indicated that the L-shaped connecting arm 98B and arm 22B are joined to one another such that all portions of connecting arm 98B and arm 22B are aligned in substantially the same common plane, as readily ascertained from FIG. 7. Integrally joined to a portion of the outer circumference of ring member 96A is the longitudinal connecting member 98A of arm 22A, as shown, said connecting member being of a straight disposition.

The operation and actuation of arms 22A and 22B is accomplished through longitudinal movement of the ratchet bars 90A and 90B, which are in turn manipulated back and forth by air cylinders 88A and 88B respectively. It can thus be seen by the constructional configuration in the drawings, that the ratchet bars 90A and 90B can be moved back and forth any distance along their respective lengths, and accordingly, the respective shafts 94A and 94B will rotate to a degree commensurate to the length of movement of each ratchet bar 90A and 90B respectively. Thus, for instance, for a fully measured travel of the ratchet bar 90A, gear 92A will correspondingly rotate one hundred and eighty degrees either clockwise or counterclockwise. This one hundred and eighty degree arcuate movement capability of gear 92A in turn defines the limits of arcuate movement of arm 22A to a corresponding one hundred and eighty degree movement. On the other hand, arm 22B, being controlled by arcuate movement of gear 92B, is limited to a ninety degree arcuate movement, specifically from a vertically upright position to a horizontal position, and back again as necessary.

The degree of movement of ratchet bars 90A and 90B, as stated above, is dependent upon the amount and timing of the air flow movement through air cylinders 88A and 88B. In turn, the movement of air through air cylinders 88A and 88B is regulated by the air control mechanism 100 located on platform 14 just adjacent air cylinders 88A and 88B. Specifically, the air control mechanism contains four solenoid members, not shown, two of which solenoid members control air in and out of air cylinder 88A, and the remaining two solenoids control air movements in and out of air cylinder 88B.

In operation of arms 22A and 22B, control mechanism 100 receives appropriate electrical signals from electric eye member 48, and other sensing units on platform 14, as to the movement and positioning of the load 50. As machine 10 is the wrapping stage, arms 22A and 22B are in the retracted mutually opposed position shown in FIG. 3. In this latter position, each arm 22A and 22B lies horizontally and opposite to one another such that the two arms are one hundred and eighty degrees apart. In this downwardly retracted position, both arms 22A and 22B lie completely beneath the bottom of load 50 and also beneath the bottom edge of the wrapping material 72 as it wraps about load 50. Consequently, this latter unique positioning of the arms which serve the holding function eliminates any possible interference between the holding arm members and the wrapping material, as seen in prior art stretch wrapping machines.

Figure 4:
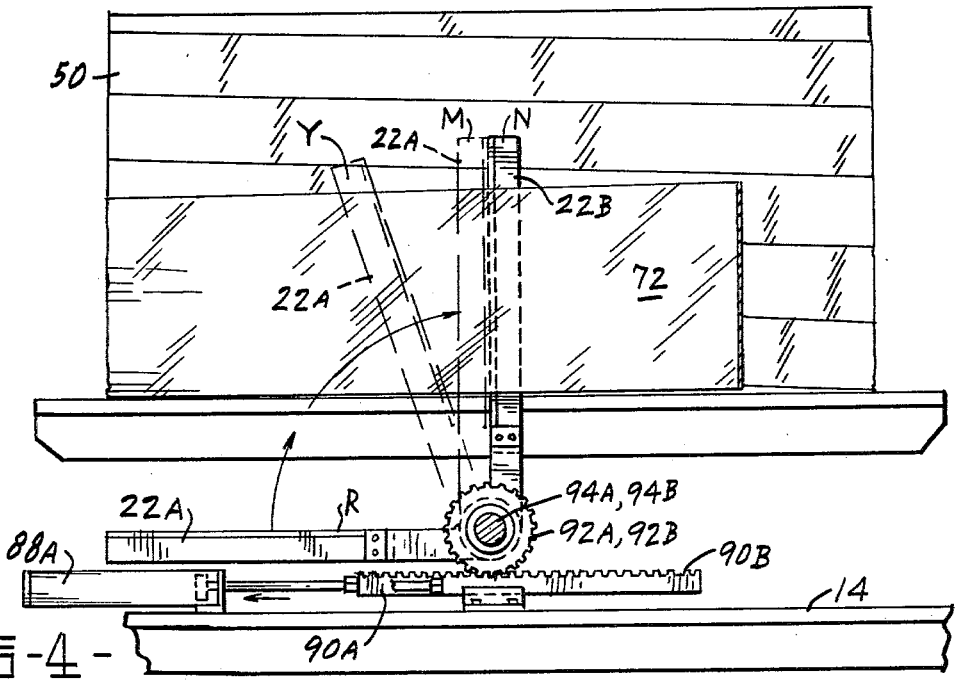
FIG. 4 is an elevational view through the same section as used for FIG. 3 showing the initial movement of the holding and cutting arms towards the cutting stage.
Figure 5:
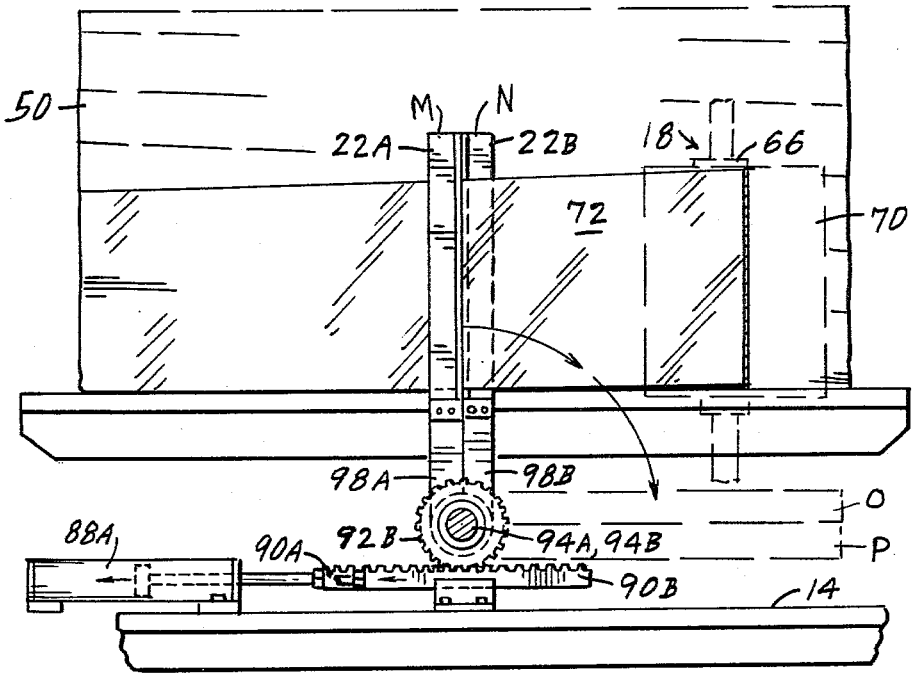
FIG. 5 is the same elevational as seen in FIGS. 3 and 4, with the holding and cutting arms positioned at the cutting phase.

Referring now to FIG. 4, as the platform commences to slow down in its rotational cycle, a signal transferred to air control unit 100, causes thereupon arm 22B to raise from the horizontal retracted position to the vertically upright position shown as position N in FIG. 4. The arm 22B is rising to upright position N will grasp the one side of unraveled wrapping material 72. Immediately after arm 22B ascends to the vertically upright position N, arm 22A will commence rising from its horizontal retracted position also, and its rate of ascent is thus phased to reach its vertically upright position M just after arm 22B becomes vertically upright. The timing of the upward movement of arm 22A is such that when arm 22B is vertically upright in position N, arm 22A will be at about position Y, shown in FIG. 4, in its upward ascent. As arm 22A reaches its vertically upward position M, it will clasp the opposite side of unraveled wrap material 72, and consequently the wrapping material 72 will be clasped between arms 22A and 22B as it extends from spool 66 to load 50. Then, as the load cycle comes to an end and the platform 14 stops rotating, the wrapping material 72 is ready to be cut so as to form a trailing end on the load 50 and a new leading cycle for the next wrap cycle. In order to accomplish this cutting sequence, the arm 22B is equipped with either a knife edge along the entire inner face of arm 22B or alternately an electrical wire 110 of high resistance is integrally affixed along the entire inner face of said arm 22B.

Figure 6:
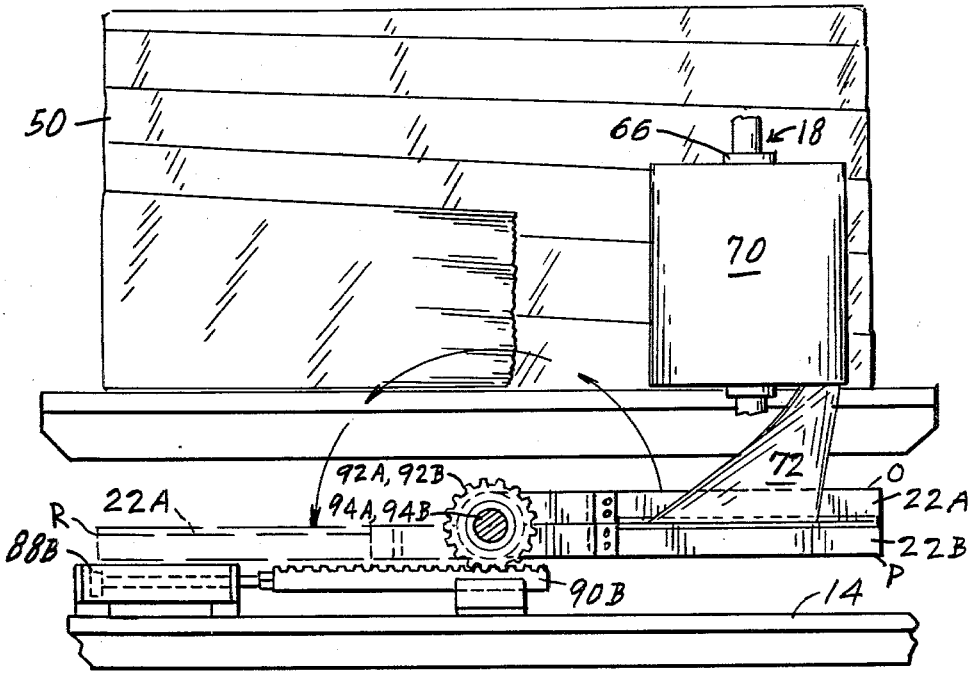
FIG. 6 is the same elevational view as shown in FIGS. 3 and 4 with the holding and cutting arms shown in the fully open, retracted position.

Upon completion of the cutting operation, as described above, the arms 22A and 22B are momentarily in the vertically upright position shown in FIG. 4. In such vertical position, the leading edge of wrapping material 72 is clasped between said arms 22A and 22B during the period in wich the platform is not rotating and awaiting the introduction of a new load for the next wrap cycle. Then, prior to the commencement of the next revolution cycle of platform 14, arms 22A and 22B are moved jointly and concurrently clockwise, in their clasped position shown as positions M & N in FIG. 4, to a horizontally clasped position shown as O & P in FIG. 5. As the arms 22A and 22B move clockwise to this horizontal position, they remain clasped, as stated, still holding these between the leading edge of the just recently cut wrapping material 72, as represented in FIG. 6. In the horizontal positions O and P, depicted in FIGS. 5 and 6, the leading edge of the wrapping material will be folded downwardly clockwise by an approximately ninety degree amount. At completion of the latter described movement and horizontal positioning of arms 22A and 22B, the machine 10 is ready to commence the next wrapping cycle. Accordingly, platform 14 will commence rotating while the arms are in position O and P in FIG. 6, and this commences the wrapping phase. The leading edge of the wrapping material will commence encircling the load as the platform 14 rotates, and as the platform rotates the wrapping material will initially encircle the lower portion of the load, and as it does, wrapping material 72 will commence almost immediately to assume a vertically upright planar disposition. Upon completion of one or more wraps, depending on the setting of machine 10, the arm 22A is rotated one hundred and eighty degrees counterclockwise to an opposing horizontal position R shown in FIG. 6. Arm 22B remains in position P during the counterclockwise movement of arm 22A, and as arms 22A and 22B unfold from their clasped positions O and P, the wrapping material 72 is thereby immediately rendered free to encircle the load in wrapping fashion unhindered without any assistance from arms 22A and 22B. The remaining portion of the wrap cycle proceeds while arms 22A and 22B are in the horizontal positions R and P shown in FIGS. 3 and 6. Then, as the load cycle is completed, the arm movement repeats itself, as discussed above, at completion of the wrap cycle.

In the embodiment discussed wherein an electrical resistance wire 110 is used on the inside face of arm 22B, a timing mechanism, not shown, is necessary to actuate appropriate signal means to activate a transformer, not shown, to direct current of moderately high voltage through wire 110 at the instant arm 22B ascends to vertical position N for the cutting stage. The wire 110 thus becomes heated at this vertical stage in order to melt the plastic material embracing the face of arm 22B. On the other hand, if mechanical wedge type cutting means are used, either or both arms 22A and 22B may include such mechanical means for this purpose.

I claim:

1. A machine for wrapping a plurality of containers in a unitized bundle with a plurality of overlapping layers of material in a wrap cycle which encompasses unraveling said wrapping material from a spool storage member to envelope said bundle, comprising:

(a) a base member;

(b) a horizontally disposed loading platform affixed on and above said base member, said loading platform having a plurality of rollers thereon;

(c) a spool member affixed to said base member and offset a lateral distance from said platform, said spool member having means thereon to hold wrapping material concentrically thereabout;

(d) holding and cutting means to hold the wrapping material and cutting same, said holding and cutting means affixed on said loading platform, said holding and cutting means comprising a pair of mutually opposing arms which are rotatably mounted on a common pivotal axis; and wherein one of said arms is pivotally mounted for a ninety degree arcuate movement between a horizontal position to a vertical position relative to the horizontal loading platform, and wherein the second of such arms is rotatably mounted in an arcuate movement between a horizontal position and an opposing horizontal position and wherein said holding and cutting means includes means:

(1) to hold said holding and cutting means in a vertically upright position with the wrapping material clasped substantially vertically upright between said arms for purposes of cutting said material at the completion of wrap cycle;

(2) to rotate said holding and cutting means together in the aforesaid clasped position with said wrapping material disposed there-between to a substantially horizontal position beneath the bottom of the load to be wrapped;

(3) to allow retraction of the arms from one another after commencement of the wrapping cycle so that one arm of the pair of arms moves from the other in an arcuate path and thereby releases the wrapping material from between the two arms;

(e) automatic means to regulate movement of said holding and cutting means.

2. In a stretch wrapping machine for wrapping a bundle on a loading platform in which said wrapping machine includes a base, a spool for wrapping material, a rotatable and horizontally disposed platform for holding the bundle while it is being wrapped, and means to hold and cut said wrapping material at various positions and at various intervals, the improvement comprising the following elements:

(a) a pair of rotatable longitudinal extending holding arm members rotatable relative to one another from, diametrically opposing positions about a common axis to a mutually aligned position against one another and wherein said axis of said arms is mounted on and located beneath the level of the horizontal platform, and wherein said arms are mutually opposed in rotatable movement on said common axis, means for pivotally moving one of said rotatable arms in a ninety degree arcuate movement between a first horizontal position below the platform to a vertical position relative to the horizontal loading platform and means for pivotally moving the second of said arms in an arcuate movement between said first horizontal position and a second horizontal position diametrically opposed to said first horizontal position;

(b) cutting means integrally affixed to one of said arm members on the longitudinally extending holding arm member;

(c) timing and coordinating means connected to said moving means to time and coordinate the relative movement of said pair of holding arms from said first and second diametrically opposing horizontal positions into alignment in said vertical position and then into alignment in said first horizontal position whereby said arms hold said wrapping material between them in said vertical and said first horizontal positions and cut said wrapping material in said vertical position.

* * * * *